US010279355B2

(12) United States Patent
Grimm et al.

(10) Patent No.: US 10,279,355 B2
(45) Date of Patent: May 7, 2019

(54) HYDRAULIC CLASSIFIERS

(71) Applicant: Superior Industries, Inc., Morris, MN (US)

(72) Inventors: Lafe Grimm, Hancock, MN (US); Shane Hanson, Columbus, NE (US); Paul Illot, Tyler, TX (US)

(73) Assignee: Superior Industries, Inc., Morris, MN (US)

( * ) Notice: Subject to any disclaimer, the term of this patent is extended or adjusted under 35 U.S.C. 154(b) by 0 days.

(21) Appl. No.: 15/666,871

(22) Filed: Aug. 2, 2017

(65) Prior Publication Data

US 2018/0043370 A1 Feb. 15, 2018

Related U.S. Application Data

(60) Provisional application No. 62/372,757, filed on Aug. 9, 2016.

(51) Int. Cl.
*B03B 5/62* (2006.01)

(52) U.S. Cl.
CPC ..... *B03B 5/623* (2013.01)

(58) Field of Classification Search
CPC ..... B03B 5/62; B03B 5/623
USPC ..... 209/155, 158
See application file for complete search history.

(56) References Cited

U.S. PATENT DOCUMENTS 2,123,156 A * 7/1938 Jagoe Walker M .. E01C 19/174 137/625.29
3,581,474 A * 6/1971 Kent ..... B01D 47/06 261/112.1
3,645,397 A * 2/1972 Weiss ..... B03B 5/52 209/464
4,533,464 A * 8/1985 Smith ..... B03B 5/66 209/158
4,539,103 A 9/1985 Hollingsworth
5,682,753 A * 11/1997 Behrens ..... A23B 7/0408 62/332
6,085,912 A 7/2000 Hacking, Jr. et al.
6,253,677 B1 * 7/2001 Switall ..... B41F 7/30 101/132.5
6,264,040 B1 * 7/2001 Mankosa ..... B03B 5/623 209/155
6,425,485 B1 7/2002 Mankosa et al.
(Continued)

FOREIGN PATENT DOCUMENTS

CN 107107071 A 8/2017
EP 809534 B1 11/1998
RU 2620819 C1 5/2017

OTHER PUBLICATIONS

CFS Inc., "Density Separator" Brochure, Holly, Michigan, 4 pages.
(Continued)

*Primary Examiner* — Terrell H Matthews
(74) *Attorney, Agent, or Firm* — Todd R. Fronek; Larkin Hoffman Daly & Lindgren, Ltd.

(57) ABSTRACT

Hydraulic classifiers are provided for sorting material using injected water. Some embodiments include upper and lower housings having different cross-sectional shapes. In some embodiments, certain improvements are provided for clean-out and/or removal or replacement of teeter bars.

20 Claims, 8 Drawing Sheets

(56) References Cited

U.S. PATENT DOCUMENTS

| | | | | |
|---|---|---|---|---|
| 6,527,960 | B1 * | 3/2003 | Bacon | B01D 17/0214 210/741 |
| 6,799,681 | B1 | 10/2004 | Warren | |
| 6,953,123 | B2 | 10/2005 | Niitti | |
| 7,147,111 | B2 | 12/2006 | Fendley | |
| 7,380,669 | B2 | 6/2008 | Hacking, Jr. et al. | |
| 7,891,496 | B2 | 2/2011 | Fendley | |
| 7,992,717 | B1 | 8/2011 | Hazen | |
| 2003/0190417 | A1 * | 10/2003 | Takei | B01J 2/006 427/213 |
| 2004/0026342 | A1 | 2/2004 | O'Brien et al. | |
| 2007/0246078 | A1 * | 10/2007 | Purtilo | A47L 15/14 134/25.2 |
| 2017/0361332 | A1 * | 12/2017 | Bennington | B03B 5/62 |
| 2018/0038057 | A1 * | 2/2018 | Hogan | G05D 7/0676 |
| 2018/0043370 | A1 * | 2/2018 | Grimm | B03B 5/623 |

OTHER PUBLICATIONS

General Rubber Corporation, "Flex-Valve", Brochure, 2 pages.
LPT Group, Inc., "LPT Hydrosizers for Aggregates" Brochure, Gallatin, TN, 2 pages
McLanahan, "Hydrosizers" Brochure, Pennsylvania, 2 pages.
MEP, "Multi-Spigot Hydrosizer" Brochure, Wilton, United Kingdom, 2 pages.
Weir Minerals NA, "Processing Technologies: Smarter Solutions", PowerPoint Slides, 26 pages.

* cited by examiner

HYDRAULIC CLASSIFIERS

DESCRIPTION

Classifiers such as hydraulic classifiers are disclosed herein. In some embodiments a rising current element such as a teeter bar (which in some embodiments may be made of a polymer, high-density polyethylene, etc.) is removable such as by a flanged connection. In some embodiments a cleanout valve is disposed outside a housing of the rising current element and disposed to allow an operator to clean the interior of the rising current element. In some embodiments an upper portion of the hydraulic classifier housing has a rectangular (e.g., square) cross-section and the lower portion of the hydraulic classifier has a round cross-section.

Figure 1:
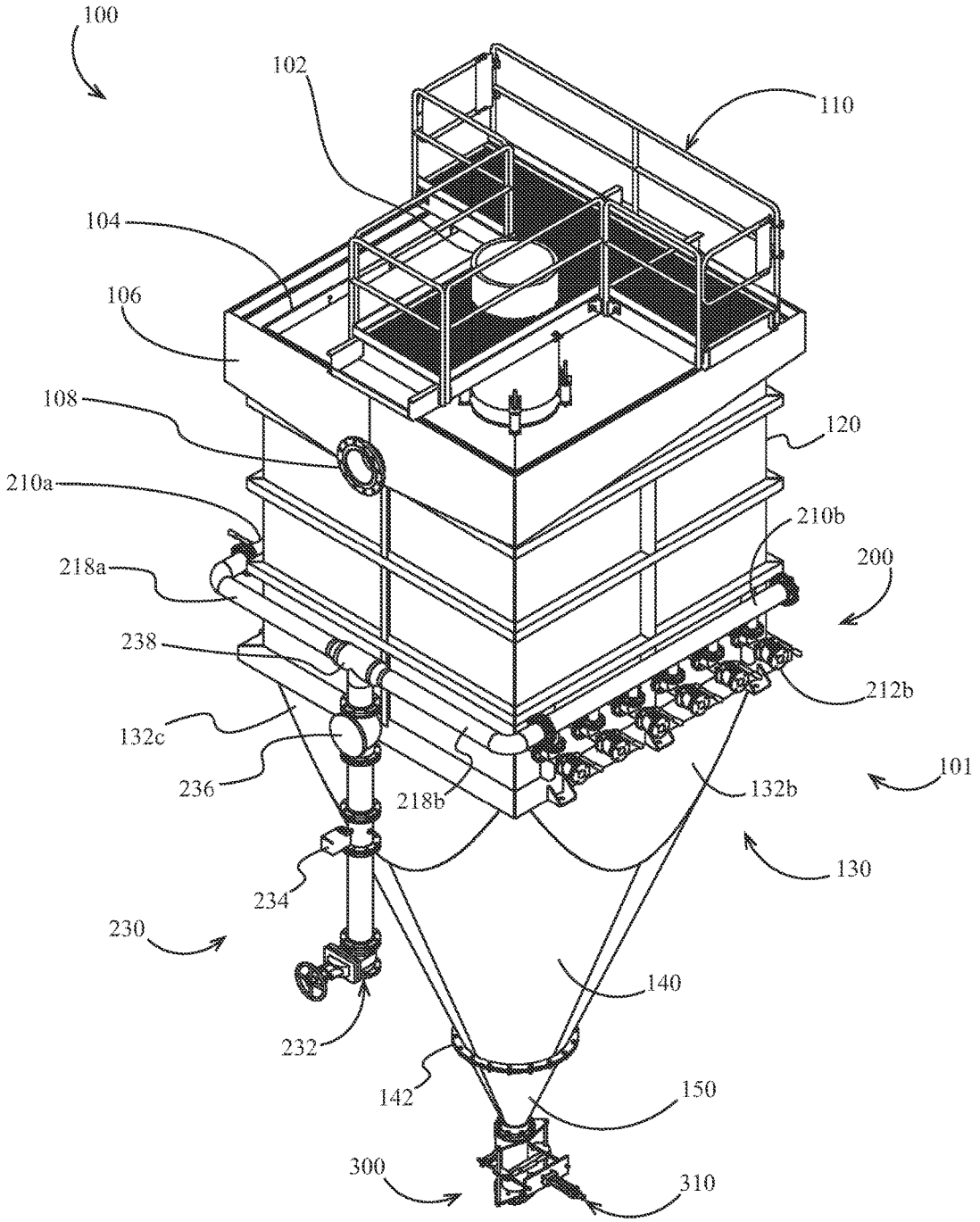
FIG. 1 is a perspective view of an embodiment of a hydraulic classifier.
Figure 2:
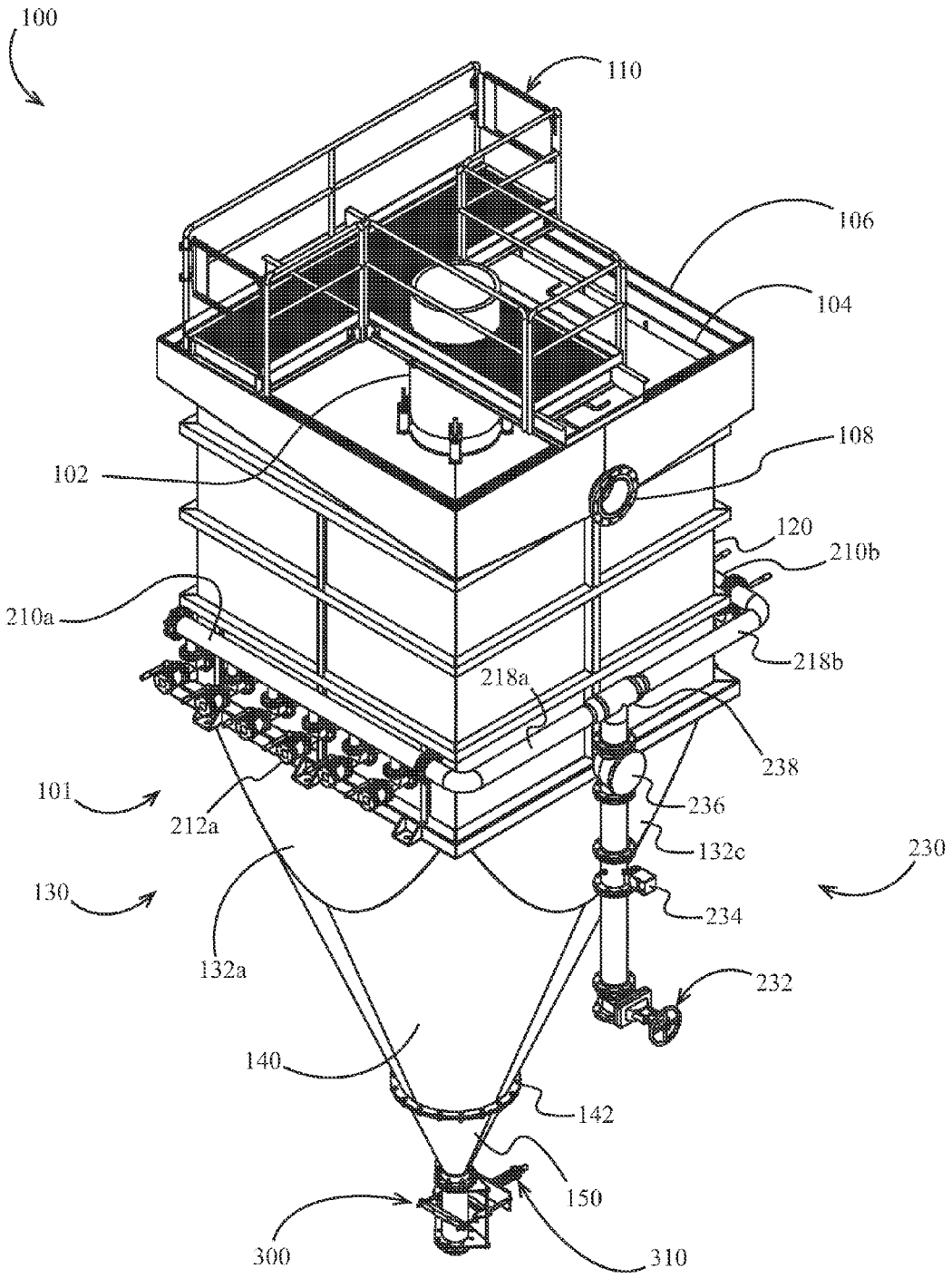
FIG. 2 is another perspective view of the hydraulic classifier of FIG. 1.
Figure 3:
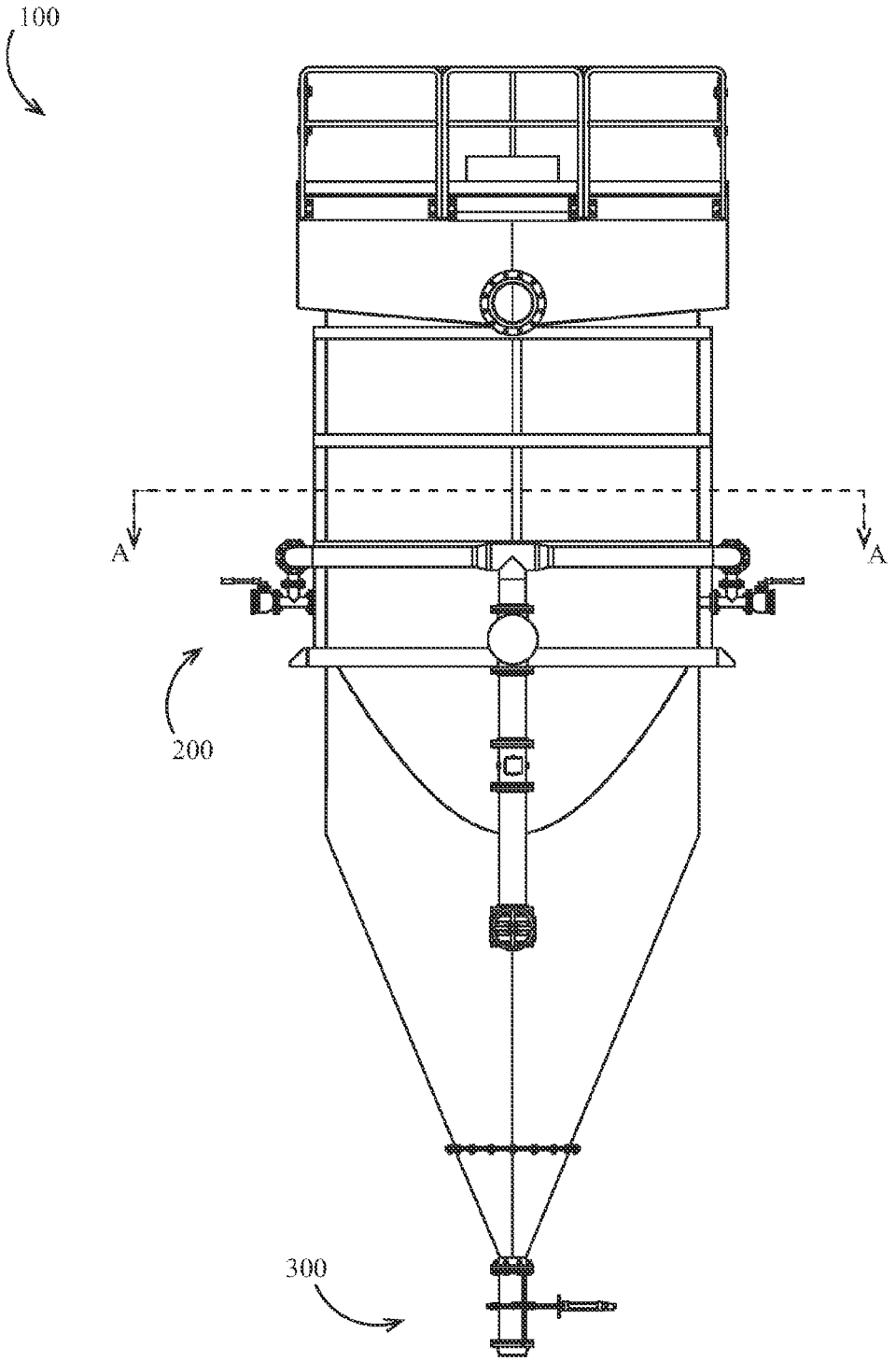
FIG. 3 is a front elevation view of the hydraulic classifier of FIG. 1.

Referring to the drawings, wherein like reference numerals designate identical or corresponding parts throughout the several views, FIGS. 1-2 illustrate a classifier 100 (e.g., hydraulic classifier, rising current classifier, and/or hindered settling classifier, etc.) according to one or more embodiments. Various embodiments described herein may have similar and/or common features and/or functionality to one or more embodiments disclosed in U.S. Pat. No. 4,533,464, incorporated herein by reference.

The classifier 100 includes a housing such as housing 101. The housing 101 optionally includes an upper housing 120 and a lower housing 140. In some embodiments, the upper housing 120 has a rectangular (e.g., square) cross-section as illustrated (e.g., referring to FIG. 4, the upper housing optionally includes sidewalls 122*a*, 122*b* and optionally includes a forward wall 124*a* and rear wall 124*b*) but may alternatively have a round (e.g., circular) or other cross-section. In some embodiments, the lower housing 140 has a round (e.g., circular) cross-section as illustrated but may alternatively have a rectangular (e.g., square) or other cross-section. In some embodiments, the lower housing 140 optionally comprises a plurality of curved plate sections which may be joined together (e.g., by welding) or may comprise a unitary structure. In some embodiments, a transitional portion 130 optionally joins the upper housing 120 to the lower housing 140. In some embodiments, the transitional portion 130 comprises a plurality of curved plate sections 132 (e.g., 132*a*, 132*b*, 132*c*, 132*d*). Each curved plate section 132 optionally includes a straight upper edge for joining (e.g., welding) to the upper housing 120 and/or an arcuate lower edge for joining (e.g., welding) to the lower housing 140. In alternative embodiments, the transitional portion comprises another structure such as a unitary structure or is omitted (e.g., by directly joining the lower housing to the upper housing).

Figure 7:
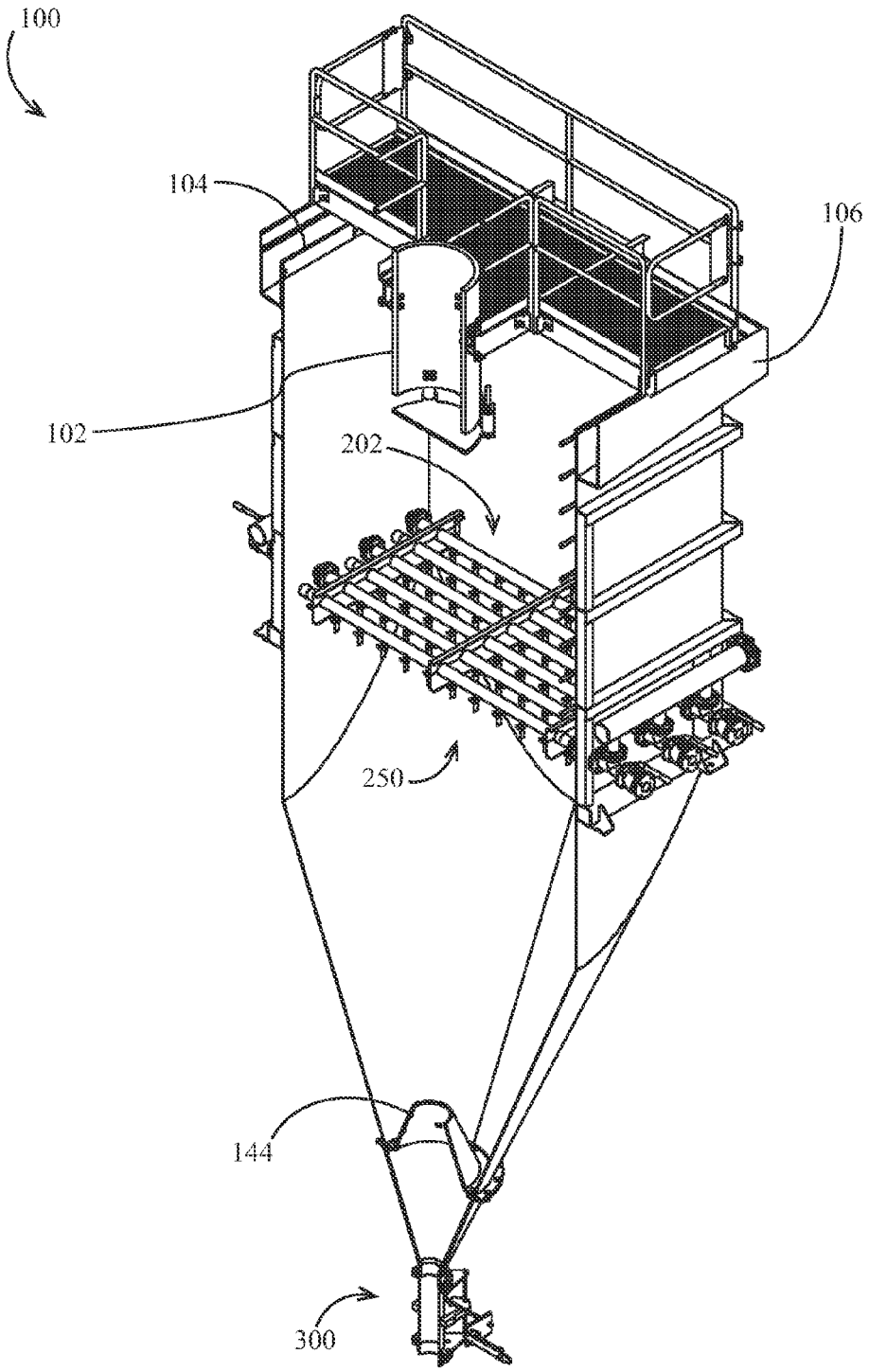
FIG. 7 is a perspective cutaway view of the hydraulic classifier of FIG. 1 cut away along the section C-C of FIG. 4.

The classifier 100 optionally includes a feed inlet 102 (e.g., a feed well, opening or other inlet which may receive material moving horizontally, vertically, etc. according to various embodiments) for receiving aggregate materials (e.g., in a slurry) into the housing 101. A water injection system 200 optionally injects water into the housing 101. The water injection system 200 optionally comprises a plurality of spray elements such as spray bars (e.g., teeter bars 220 which may form a teeter bed 202 as illustrated) or ring-shaped or other spray elements. A valve array 250 of valves 252 in fluid communication with one or more spray elements optionally injects (and/or allows, releases, dispenses, etc.) water (and/or air or other fluid or material) into the housing 101. In some embodiments, the valves 252 comprise (and/or are replaced with) outlets (e.g., valve outlets, openings, conduit openings, etc.) of the spray elements; in some embodiments, the valves 252 comprise devices for directing and/or selectively opening an inlet stream from the spray element. The water injection from the spray elements optionally creates a rising current inside the housing 101 (e.g., in the upper housing 120). The spray element and/or rising current optionally creates a density separation zone Z such as a teeter zone (e.g., above one or more rising current elements which may form a teeter bed 202) in which the aggregate materials are optionally separated according to density. Aggregate material having greater than a critical density optionally descends into (and/or further into) the lower housing 140 and/or out of the classifier. In some embodiments, aggregate material passes through a tapered housing segment 150 out of a lower end of housing 101. The lower housing 140 is optionally removably mounted to the tapered housing segment (e.g., by a bolted flange 142). Referring to FIG. 7, a baffle 144 (e.g., an upwardly tapering frustrum as illustrated) is optionally disposed at a lower end of the lower housing 140. Aggregate materials passing from the lower end of housing 101 optionally pass through an underflow outlet 300.

Figure 8:
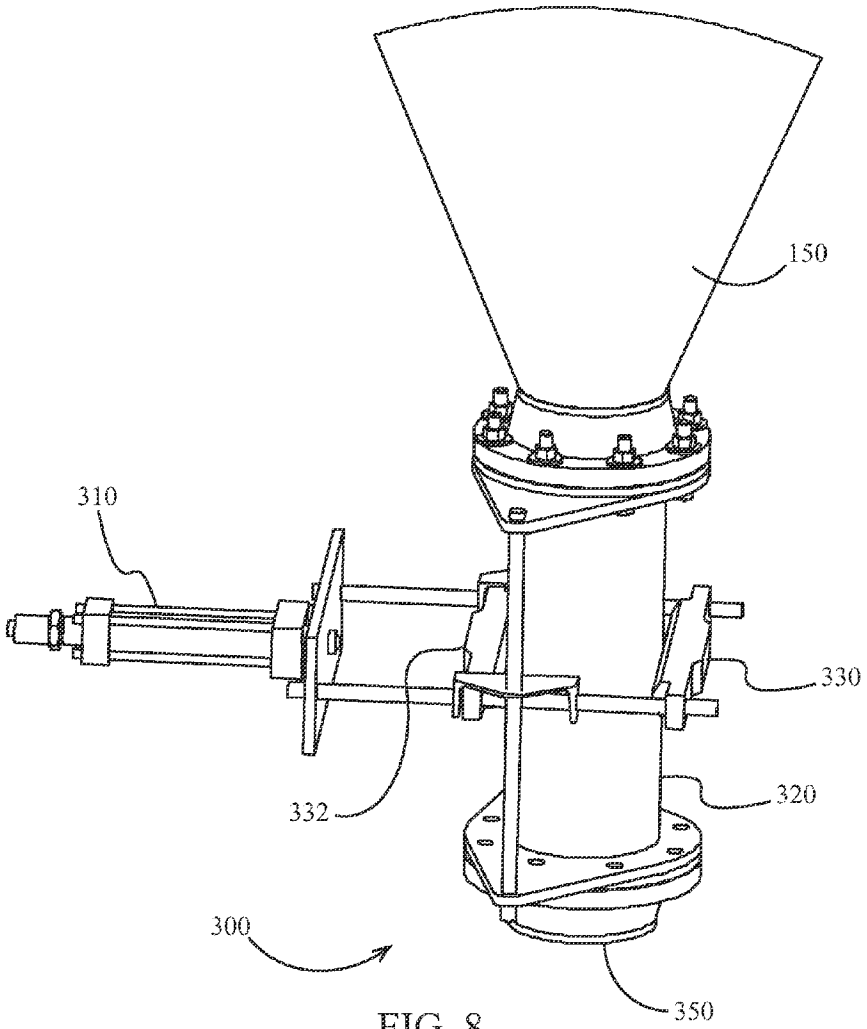
FIG. 8 is a perspective view of an underflow outlet of the hydraulic classifier of FIG. 1.

Referring to FIG. 8, the underflow outlet 300 optionally includes an actuator 310 (e.g., hydraulic actuator or pneumatic actuator) which is optionally disposed and/or configured to selectively close (e.g., partially close, fully close) the underflow outlet to reduce or stop fluid flow out of a lower outlet 350 of the underflow outlet 300. In some embodiments, the underflow outlet 300 includes a flexible portion 320 (e.g., a flexible conduit such as a rubber cylinder). In some embodiments, the actuator 310 is disposed to squeeze the flexible portion 320 to close the outlet 300. For example, in the illustrated embodiment the actuator is configured to squeeze the flexible portion 320 between clamps 330 and 332. The actuator 310 is optionally controlled by a controller in data communication with a valve (e.g., flow control valve, directional control valve, pressure control valve, etc.) configured to retract and extend the actuator. The controller is optionally in data communication with the pressure sensor 235; the controller optionally determines an extension of actuator 235 based on the measurement signal produced by the pressure sensor 235.

Referring to FIGS. 1 and 2, in some embodiments the water injection system 200 comprises an inlet 230 (e.g., a vertically disposed inlet, a water inlet, etc.) optionally in fluid communication with a source of water and/or other fluid. A valve 232 (e.g., gate, two-position valve, flow control valve, etc.) is optionally provided in the inlet 230 to close and/or modify a flow rate of water entering the inlet 230. The valve 232 may optionally be selectively partially and/or completely opened or close using an interface such as a wheel (as illustrated), dial, lever, or remote controller. In some embodiments, the valve 232 is omitted and/or disposed remotely from the classifier.

In some embodiments, a flow meter 234 is optionally disposed along the inlet 230 and in fluid communication with the inlet 230. The flow meter 234 is optionally configured to generate a flow signal related to a flow rate of water entering the inlet 230. In some embodiments, a check valve 236 is optionally provided in the inlet 230 such that water is allowed to enter the system 200 but not allowed to exit the system 200. In some embodiments the flow meter is omitted or replaced with a different sensor or controller.

Figure 4:
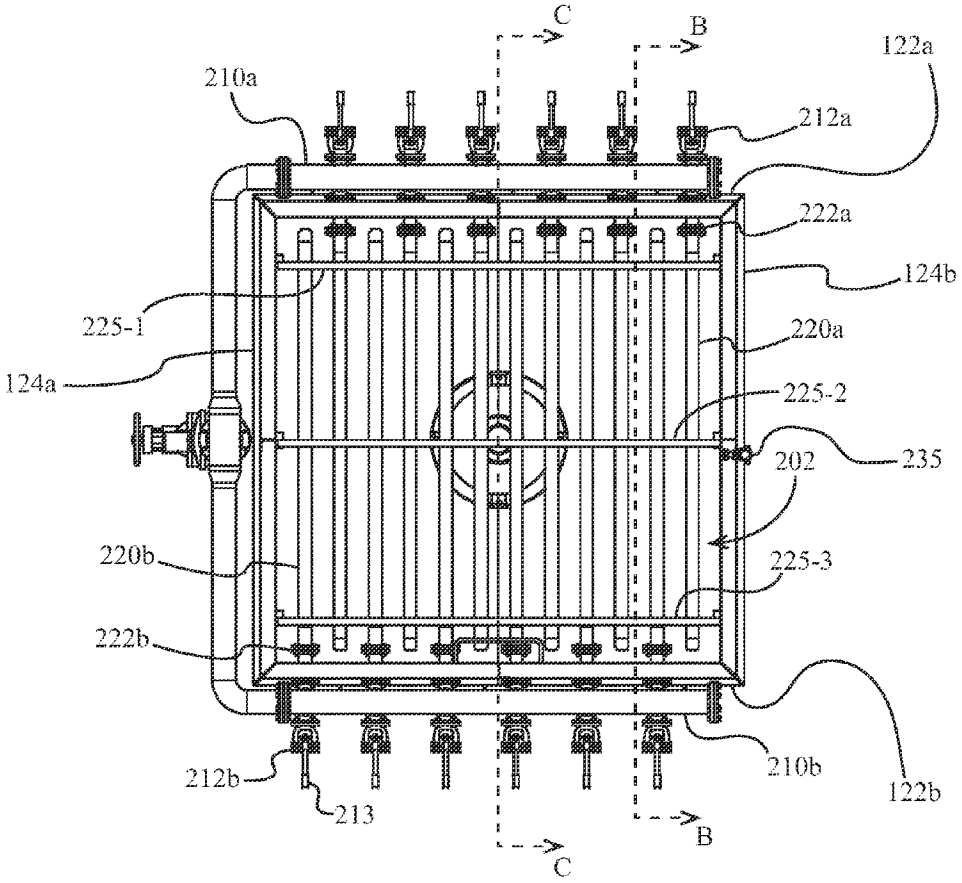
FIG. 4 is a cross-sectional view of the hydraulic classifier of FIG. 1 along the section A-A of FIG. 3.

Referring to FIG. 4, in some embodiments one or more pressure sensors 235 are used to determine pressure inside the classifier. The pressure sensor 235 is optionally mounted to a wall or sidewall of the housing and/or extends through the housing. In various embodiments, one or more pressure sensors are disposed to measure pressure at one or more heights (e.g., above the teeter bars, above the teeter zone, in the teeter zone, below the teeter bars, below the teeter zone, etc.). In various embodiments, one or more pressure sensors are disposed to measure pressure at various horizontal distances from a sidewall of the housing (e.g., adjacent to a sidewall, near a sidewall, remote from a sidewall, etc.).

The inlet 230 is optionally in fluid communication with pipes 218*a*, 218*b* via a T-connection 238. In various embodiments, any pipe, elbow, T-connection or other fluid connection disclosed herein (including but not limited to pipes 218, 210) may comprise any suitable rigid, flexible or inflexible conduit and may be fixed or moveable and may be of circular, square, elliptical or any other cross-section. The pipes 218*a*, 218*b* are optionally in fluid communication with pipes 210*a*, 210*b*, respectively (e.g., via elbow connections as illustrated).

Each pipe 210 (e.g., pipes 210*a*, 210*b*) is optionally in fluid communication with a spray element such as an array of teeter bars 220 forming teeter bed 202 (or in some embodiments a teeter ring or other spray element). Each teeter bar 220 optionally comprises a hollow tube having a first end in fluid communication with the pipe 210 and a second terminal (e.g., closed) end. Each teeter bar 220 is optionally made of a polymer such as high-density polyethylene (HDPE), or in other embodiments may be made of metal or other suitable material. Each teeter bar 220 is optionally in fluid communication with a plurality of valves 252 (or in some embodiments, simple openings in the teeter bar) disposed along the length of the teeter bar. In various embodiments, the valves 252 are downwardly oriented as illustrated, or may be oriented upward, sideways or otherwise oriented. The valves 252 are optionally disposed and configured to create an upward rising current above the teeter bed 202. In some embodiments, the valves 252 comprise check valves. In some embodiments, the valves 252 comprise duckbill-style valves (e.g., rubber duckbill valves such as the Flex Valve Style 4100 available from General Rubber in Carlstadt, N.J.).

Aggregate material having less than the critical density optionally flows upward under the influence of the rising current in the density separation zone Z and optionally over an optional weir 104 or other structure. In various embodiments the weir and/or launder may have a generally square, circular, elliptical, rectangular, or other configuration. Material flowing over weir 104 optionally flows (e.g., by gravity) along a launder 106 into an overflow outlet 108.

Cleanout valves 212 (e.g., 212*a*, 212*b*) or other selectively closable openings are optionally provided (e.g., in fluid communication with the spray element) for allowing an operator to access and/or clean an internal valve of some or all of the teeter bars 220. The cleanout valves 212 optionally comprise ball valves. Each cleanout valve optionally comprises a user interface 213 (e.g., a dial or lever) for opening and closing the valve 212. In an open position, a rod or brush (e.g., a straight rod or brush) is optionally insertable (and may optionally be inserted) through the valve 212 into the associated teeter bar 220 (e.g., an internal volume thereof). In some embodiments, a rod, brush or other cleaning apparatus is insertable into a teeter bar via the valve 212 due to the alignment of the opening in the valve with the interior volume (e.g., plenum, horizontally extending internal volume, generally cylindrical internal volume, etc.) of the teeter bar. In a closed position, the valve 212 optionally prevents water from escaping the system 200 via the valve 212.

In some embodiments, one or more cleanout valves may be omitted and/or replaced with other access devices such as a manifold optionally disposed outside the housing 110 and optionally in fluid communication with one or more teeter bars.

Some or all of the teeter bars 220 are optionally selectively removable and/or replaceable. In the illustrated embodiment, the teeter bars 220 are shown optionally supported at least partially by a plurality of supports such as lower supports 227 (e.g., beams, bars, brackets, etc.) which are optionally mounted (e.g., welded) to the housing 101. One or more upper supports 225 (e.g., beam, bar, bracket, etc.) are optionally removably mounted (e.g., by bolts or other fasteners) to each lower support 227 (and/or to the housing 101) to secure the teeter bars in position. In the illustrated embodiment, three upper supports 225-1, 225-2, 225-3 are optionally removably mounted to three lower supports 227-1, 227-2, 227-3; in other embodiments, more or fewer supports and/or supports of a different configuration are used.

Each teeter bar 220 is optionally selectively (e.g., releasably) fluidly coupled to a pipe 223 (or other conduit) disposed at least partially outside the housing 101 by a fluid coupling such as a flanged connection 222 or other selectively disengageable fluid coupling. In some embodiments, the flanged connection 222 may be disengaged (such as by removing one or more fasteners) to remove the teeter bar. The flanged connection 222 is optionally disposed inside the housing 101. In some embodiments, a pipe 224 (or other conduit) optionally extends at least partially through the housing 101 (e.g., through a sidewall 122 thereof); the pipe 224 may be selectively (e.g., releasably) fluidly coupled at a first end thereof to the pipe 223 by a fluid coupling 226 (e.g., flanged connection or other fluid coupling) which may be disposed outside the housing and the pipe 224 may be selectively (e.g., releasably) fluidly coupled at a second end thereof to the teeter bar 220 by the flanged connection 222 or other fluid coupling, which may be disposed inside the housing 101.

Figure 5:
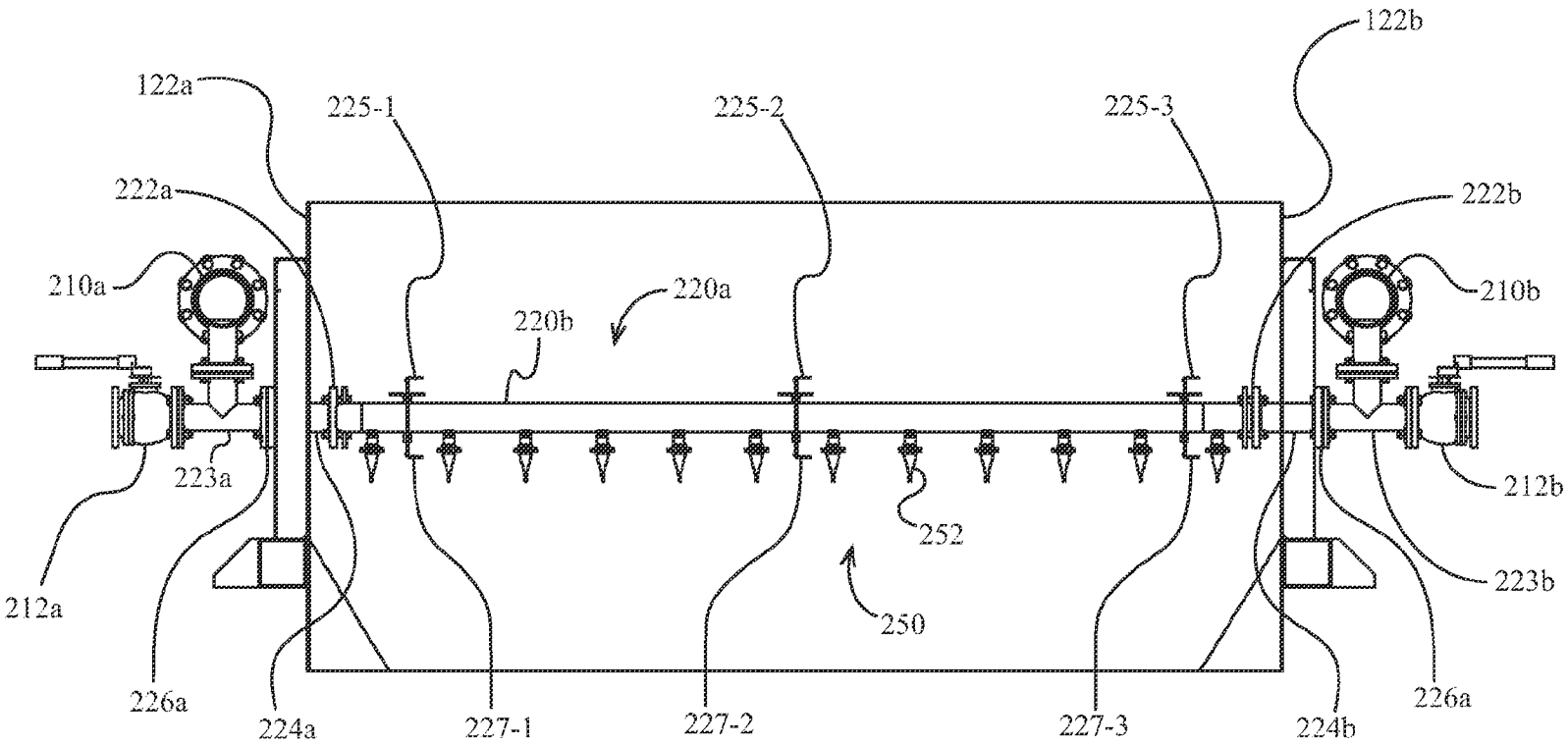
FIG. 5 is a partial cross-sectional view of the hydraulic classifier of FIG. 1 along the section B-B of FIG. 4.
Figure 6:
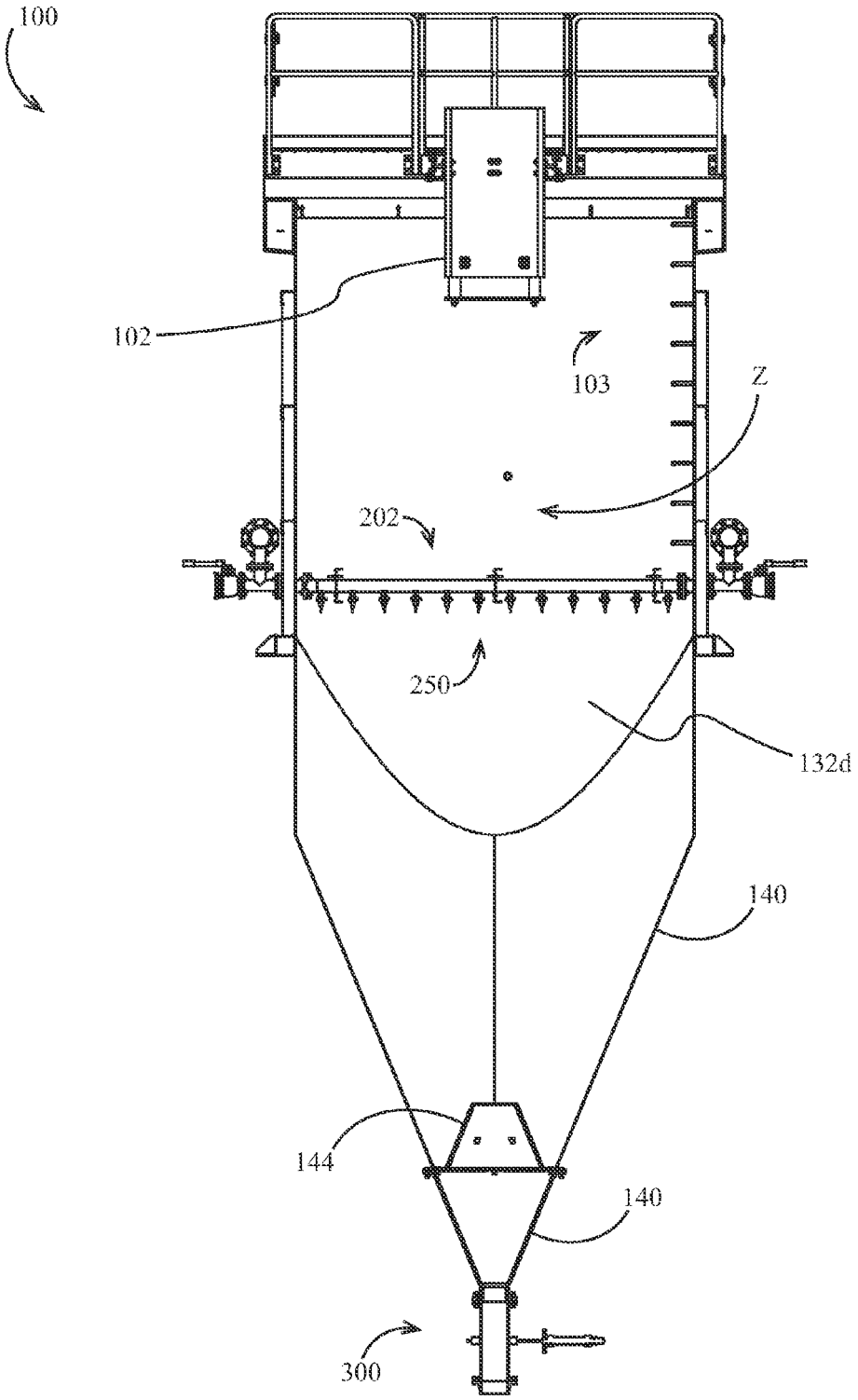
FIG. 6 is a cross-sectional view of the hydraulic classifier of FIG. 1 along the section C-C of FIG. 4.

One exemplary embodiment of a teeter bar is described in this paragraph. In the exemplary embodiment, a teeter bar 220*a* (disposed at least partially behind teeter bar 220*b* on the view of FIG. 5) is fluidly coupled to a pipe 224*a* by a first fluid coupling such as a flanged connection 222*a*. In the exemplary embodiment, a teeter bar 220*b* is fluidly coupled to a pipe 224*b* by a second fluid coupling such as flanged connection 222*b*. In the exemplary embodiment, the flanged connections 222*a*, 222*b* are disposed between the sidewalls 122*a*, 122*b* of the upper housing 120. In the exemplary embodiment, the pipe 224*a* extends through (and is optionally at least partially supported by) the sidewall 122*a*. In the exemplary embodiment, the pipe 224*b* extends through (and is optionally at least partially supported by) the sidewall 122*b*. In the exemplary embodiment, the fluid pipe 224*a* is fluidly coupled to a pipe 223*a* by fluid coupling 226*a* such as a flanged connection. In the exemplary embodiment, the fluid pipe 224*b* is fluidly coupled to a pipe 223*b* by a fluid coupling 226*b* such as a flanged connection. In the exemplary embodiment, the fluid couplings 226*a*, 226*b* are disposed outside the upper housing 120. In the exemplary embodiment, the pipes 223*a*, 223*b* extend generally parallel to the teeter bars 220*a*, 220*b*, respectively. In the exemplary embodiment, the pipes 223*a*, 223*b* are fluidly coupled to valves 212*a*, 212*b*, respectively (e.g., by releasable fluid couplings such as flanged connections). In the exemplary embodiment, the pipes 223*a*, 223*b* are fluidly coupled to pipes 210*a*, 210*b*, respectively (e.g., by releasable fluid couplings such as flanged connections).

Referring to FIG. 4, in some embodiments one or more teeter bars 220*a* (e.g., 6 teeter bars as illustrated, or another number of teeter bars) are supported adjacent to a first portion of the housing 101 (e.g., sidewall 122*a*); a terminal end (e.g., closed end) of each teeter bar 220*a* is optionally disposed adjacent a second portion of the housing 101 (e.g., sidewall 122*b*). In some embodiments one or more teeter bars 220*b* (e.g., 6 teeter bars as illustrated, or another number of teeter bars) are supported adjacent to the second portion of the housing 101 (e.g., sidewall 122*b*); a terminal end (e.g., closed end) of each teeter bar 220*b* is optionally disposed adjacent the first portion of the housing 101 (e.g., sidewall 122*a*).

In a maintenance mode, a teeter bar 220 is optionally removed or replaced by an operator. The operator optionally approaches the teeter bed by descending (e.g., from a platform 110) on a ladder 103 or other support which may be supported by housing 101 in some embodiments. The operator optionally decouples the teeter bar 220 from the flanged connection 222. The operator optionally removes the upper supports 225 in order to free the teeter bar 220 for removal.

In some embodiments, one or more controllers are used to modify operating criteria (e.g., a position or setting of actuator 310, a position or setting of valve 232) of one or more classifier embodiments described herein. In some embodiments, one or more controllers comprise electrical or electronic controllers. In some embodiments, one or more controllers modify the operating criteria based on a user input. In some embodiments, one or more controllers are in data communication with one or more sensors (e.g., pressure sensor 235, flow meter 234). In some embodiments, one or more controllers modify the operating criteria based on a measurement made by one or more of the sensors (e.g., pressure sensor 235, flow meter 234, etc.). For example, in some embodiments, one or more controllers contains information stored in memory (e.g., database, look-up table, etc.) relating one or more sensor measurement values (e.g., flow rate, pressure) with operating criteria settings. In some embodiments, one or more operating criteria are set manually and/or by user input.

In various embodiments, the classifier embodiments described herein may be self-standing and/or may be incorporated in a plant having other equipment thereon. The classifier and/or plant may be stationary or portable (e.g., supported on skids, tracks, or wheels) according to various embodiments. In some embodiments, material (e.g., underflow) from one or more hydrocyclones is transferred (e.g., by gravity, by one or more pumps, by one or more conveyors, etc.) into the inlet of the classifier. In some embodiments, the underflow of the classifier is transferred (e.g., by gravity, by one or more pumps, by one or more conveyors, etc.) to a dewatering mechanism such as a dewatering screen.

Unless otherwise indicated expressly or by the context or function of various components, the components described herein may be made of metal such as steel.

Ranges recited herein are intended to inclusively recite all values within the range provided in addition to the maximum and minimum range values. Headings used herein are simply for convenience of the reader and are not intended to be understood as limiting or used for any other purpose.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents. For example, any feature described for one embodiment may be used in any other embodiment.

The invention claimed is:

1. A hydraulic classifier, comprising:

a housing including an upper housing portion and a lower housing portion;

an overflow outlet supported on said upper housing portion;

a feed inlet disposed to receive aggregate material into said upper housing portion;

a water injection system, the water injection system comprising:

a conduit; and a plurality of teeter bars in fluid communication with said conduit, each of said plurality of teeter bars being fluidly coupled to said conduit via a selectively disengageable coupling, said disengageable coupling having an engaged state and a disengaged state, said teeter bars being disposed at least partially inside said housing when coupled to said conduit, said teeter bars being removable from within said housing in said disengaged state of said disengageable coupling; and an underflow outlet in fluid communication with said lower housing portion.

2. The hydraulic classifier of claim 1, wherein each of said plurality of teeter bars is at least partially supported by said selectively disengageable coupling.

3. The hydraulic classifier of claim 1, wherein said selectively disengageable coupling comprises a flanged connection, wherein each of said plurality of teeter bars is at least partially supported by said flanged connection.

4. The hydraulic classifier of claim 3, wherein said flanged connection is disposed inside said housing.

5. The hydraulic classifier of claim 4, wherein said conduit is disposed outside said housing.

6. The hydraulic classifier of claim 1, wherein said upper housing portion has a rectangular cross-section, and wherein said lower housing portion has a circular cross-section.

7. The hydraulic classifier of claim 1, wherein each said teeter bar comprises a plurality of valves, wherein each said valve comprises a duckbill valve.

8. The hydraulic classifier of claim 1, further comprising:

an underflow valve; and an actuator disposed to selectively at least partially close said underflow valve, wherein said actuator is a hydraulic actuator.

9. The hydraulic classifier of claim 1, wherein each said teeter bar comprises a horizontally-extending cylindrical portion comprising a polymer.

10. The hydraulic classifier of claim 9, wherein said polymer comprises high-density polyethylene.

11. The hydraulic classifier of claim 1, further comprising:

a plurality of valves, each said valve having an open configuration and a closed configuration, each said valve being associated with and aligned with one of said teeter bars, each said valve permitting access to at least one of said teeter bars in the open configuration.

12. The hydraulic classifier of claim 1, further comprising:

a pipe extending through said housing, said pipe fluidly coupling said selectively disengageable coupling to said conduit.

13. The hydraulic classifier of claim 1, further comprising:

a lower support, at least one of said teeter bars being at least partially supported on said lower support; and a removable upper support, wherein at least one of said teeter bars is removable upon removal of said removable upper support and disengagement of said selectively disengageable coupling.

14. A hydraulic classifier, comprising:

a housing including an upper housing portion and a lower housing portion, said upper housing portion having a first sidewall and a second sidewall;

a weir supported on said upper housing portion;

a launder supported on said upper housing portion, said weir disposed between said upper housing portion and said launder, said launder including an overflow outlet;

a feed inlet disposed to receive aggregate material into said upper housing portion;

a water injection system, the water injection system comprising:

a first conduit disposed outside said upper housing portion, said first conduit being in fluid communication with a water inlet;

a first plurality of teeter bars, each of said first plurality of teeter bars being fluidly coupled to one of a first plurality of pipes via one of a first plurality of selectively disengageable couplings, each of said first plurality of pipes extending through said first sidewall, each of said first plurality of pipes being fluidly coupled to said first conduit, each of said first plurality of teeter bars having a terminal end adjacent to said second sidewall, said terminal end being unconnected to said second sidewall;

a second conduit disposed outside said upper housing portion, said second conduit being in fluid communication with said water inlet; and a second plurality of teeter bars, each of said second plurality of teeter bars being fluidly coupled to one of a second plurality of pipes via one of a second plurality of selectively disengageable couplings, each of said second plurality of pipes extending through said second sidewall, each of said second plurality of pipes being fluidly coupled to said second conduit, each of said second plurality of teeter bars having a terminal end adjacent to said first sidewall, said terminal end being unconnected to said first sidewall; and an underflow outlet in fluid communication with said lower housing portion.

15. The hydraulic classifier of claim 14, wherein each of said first and second pluralities of selectively disengageable couplings comprises a flanged connection, wherein each of said first and second pluralities of teeter bars is at least partially supported by said flanged connection.

16. The hydraulic classifier of claim 15, wherein said flanged connection is disposed inside said housing.

17. The hydraulic classifier of claim 14, wherein said upper housing portion has a rectangular cross-section, and wherein said lower housing portion has a circular cross-section.

18. The hydraulic classifier of claim 14, wherein each said teeter bar comprises a plurality of valves, wherein each said valve comprises a duckbill valve.

19. The hydraulic classifier of claim 14, wherein each said teeter bar comprises a horizontally-extending cylindrical portion comprising a polymer.

20. The hydraulic classifier of claim 19, wherein said polymer comprises high-density polyethylene.

* * * * *